US009249775B2

(12) United States Patent
Schremmer et al.

(10) Patent No.: US 9,249,775 B2
(45) Date of Patent: Feb. 2, 2016

(54) METHOD FOR IGNITING A FUEL/AIR MIXTURE OF A COMBUSTION CHAMBER, IN PARTICULAR IN AN INTERNAL COMBUSTION ENGINE, BY CREATING A CORONA DISCHARGE

(75) Inventors: Torsten Schremmer, Asperg (DE); Gerd Bräuchle, Hüffenhardt (DE); Martin Trump, Stuttgart (DE); Steffen Bohne, Freiberg (DE)

(73) Assignee: BORGWARNER BERU SYSTEMS GMBH, Ludwigsburg (DE)

( * ) Notice: Subject to any disclaimer, the term of this patent is extended or adjusted under 35 U.S.C. 154(b) by 1041 days.

(21) Appl. No.: 13/153,144

(22) Filed: Jun. 3, 2011

(65) Prior Publication Data

US 2011/0297132 A1 Dec. 8, 2011

(30) Foreign Application Priority Data

Jun. 4, 2010 (DE) ..... 10 2010 023 104
Sep. 4, 2010 (DE) ..... 10 2010 045 044

(51) Int. Cl.
*F02P 23/00* (2006.01)
*F02P 9/00* (2006.01)
*F02P 23/04* (2006.01)

(52) U.S. Cl.
CPC ..... *F02P 23/04* (2013.01)

(58) Field of Classification Search
CPC ..... F02P 9/007; F02P 23/04; F02N 2027/36; F02D 2041/2051
USPC ..... 123/606, 608, 143 B, 162, 143 A, 536, 123/623, 169 CL, 598
See application file for complete search history.

(56) References Cited

U.S. PATENT DOCUMENTS

| | | | | | |
|---|---|---|---|---|---|
| 3,800,179 | A * | 3/1974 | Louzecky | 313/118 |
| 4,787,360 | A * | 11/1988 | Filippone | 123/406.66 |
| 5,793,151 | A * | 8/1998 | Kagawa et al. | 313/141 |
| 5,941,208 | A * | 8/1999 | Biemelt et al. | 123/295 |
| 6,512,375 | B1 * | 1/2003 | Yamada et al. | 324/399 |
| 6,752,122 | B2 * | 6/2004 | Yuya | 123/295 |

(Continued)

FOREIGN PATENT DOCUMENTS

| | | | |
|---|---|---|---|
| DE | 10243271 | A1 | 9/2002 |
| WO | 2010011838 | A1 | 1/2010 |
| WO | WO 2010011838 | A1 * | 1/2010 |

*Primary Examiner* — Thomas Moulis
*Assistant Examiner* — Elizabeth Hadley
(74) *Attorney, Agent, or Firm* — Keith Orum; Orum & Roth LLC

(57) ABSTRACT

Method for igniting a fuel/air mixture in a cyclically operating internal combustion engine comprising combustion chambers which are delimited by walls that are at ground potential, using an ignition device comprising an ignition electrode provided in each combustion chamber, in which method, via an electrical DC/AC converter, an electric oscillating circuit is excited, which is connected to the secondary side of the DC/AC converter, and in which the ignition electrode, which is guided through one of the walls delimiting the combustion chamber in a manner in which it is electrically insulated from said walls by an insulator and extends into the combustion chamber, constitutes a capacitance in cooperation with the walls of the combustion chamber that are at ground potential, and in which the excitation of the oscillating circuit is controlled so a corona discharge igniting the fuel/air mixture is created in each combustion chamber at the ignition electrode.

19 Claims, 6 Drawing Sheets

(56) References Cited

U.S. PATENT DOCUMENTS 8,607,770 B2 * 12/2013 Kraus et al. ..... 123/644
8,701,638 B2 * 4/2014 Schremmer ..... 123/606
2001/0017125 A1 * 8/2001 Matsubara et al. ..... 123/310
2004/0129241 A1 7/2004 Freen
2011/0114071 A1 * 5/2011 Freen ..... 123/623

* cited by examiner

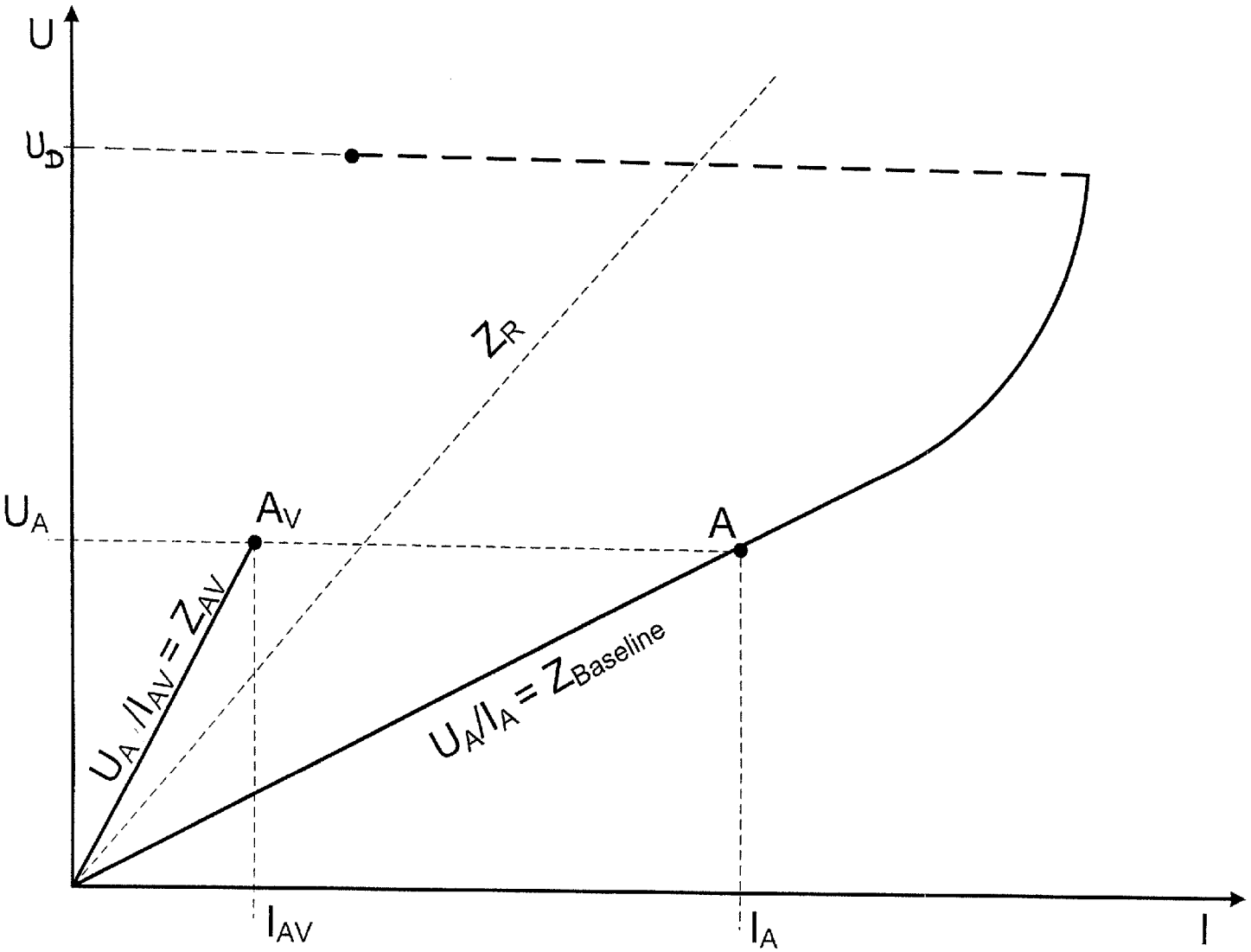
Figur 3

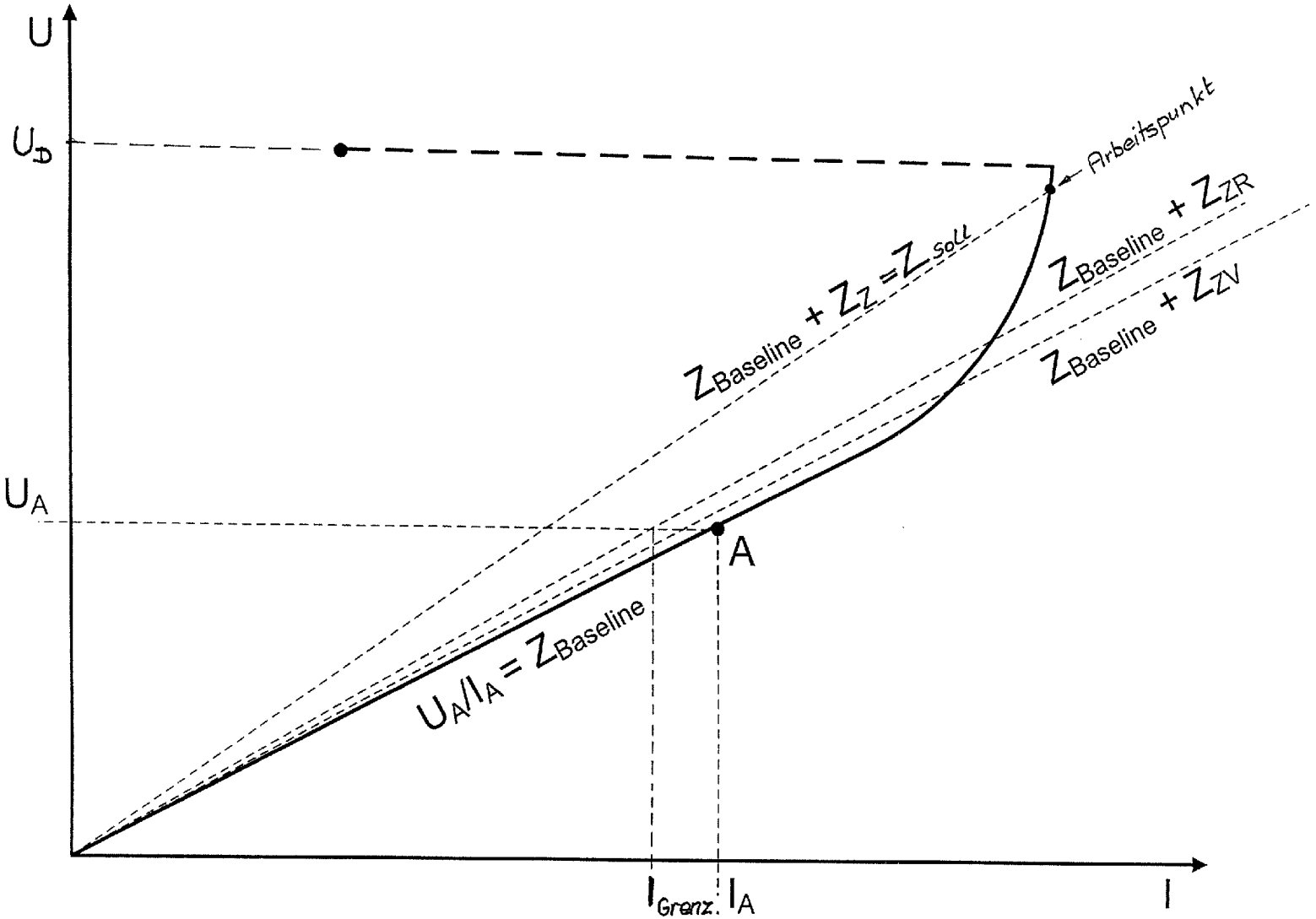
Figur 4

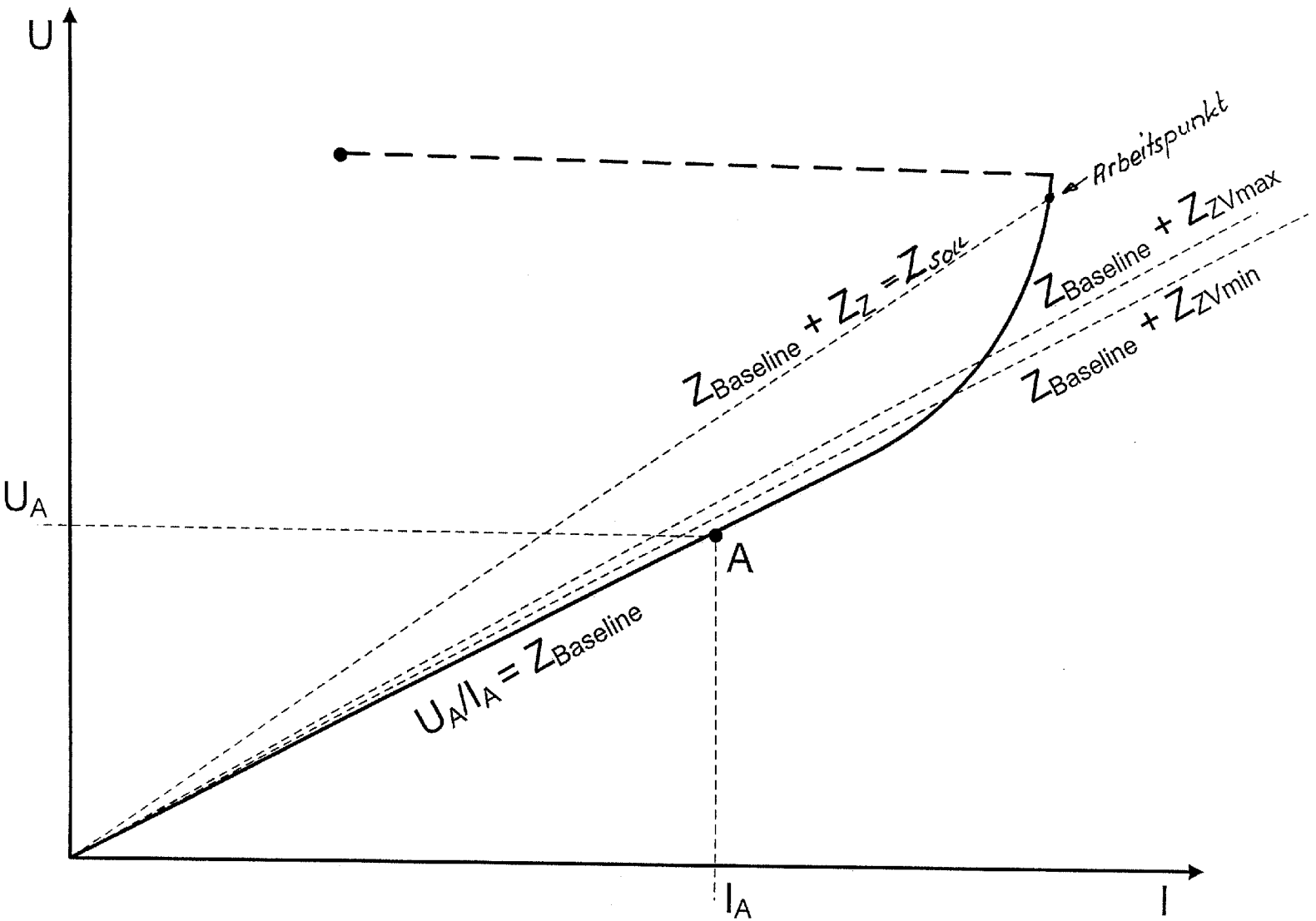
Figur 5

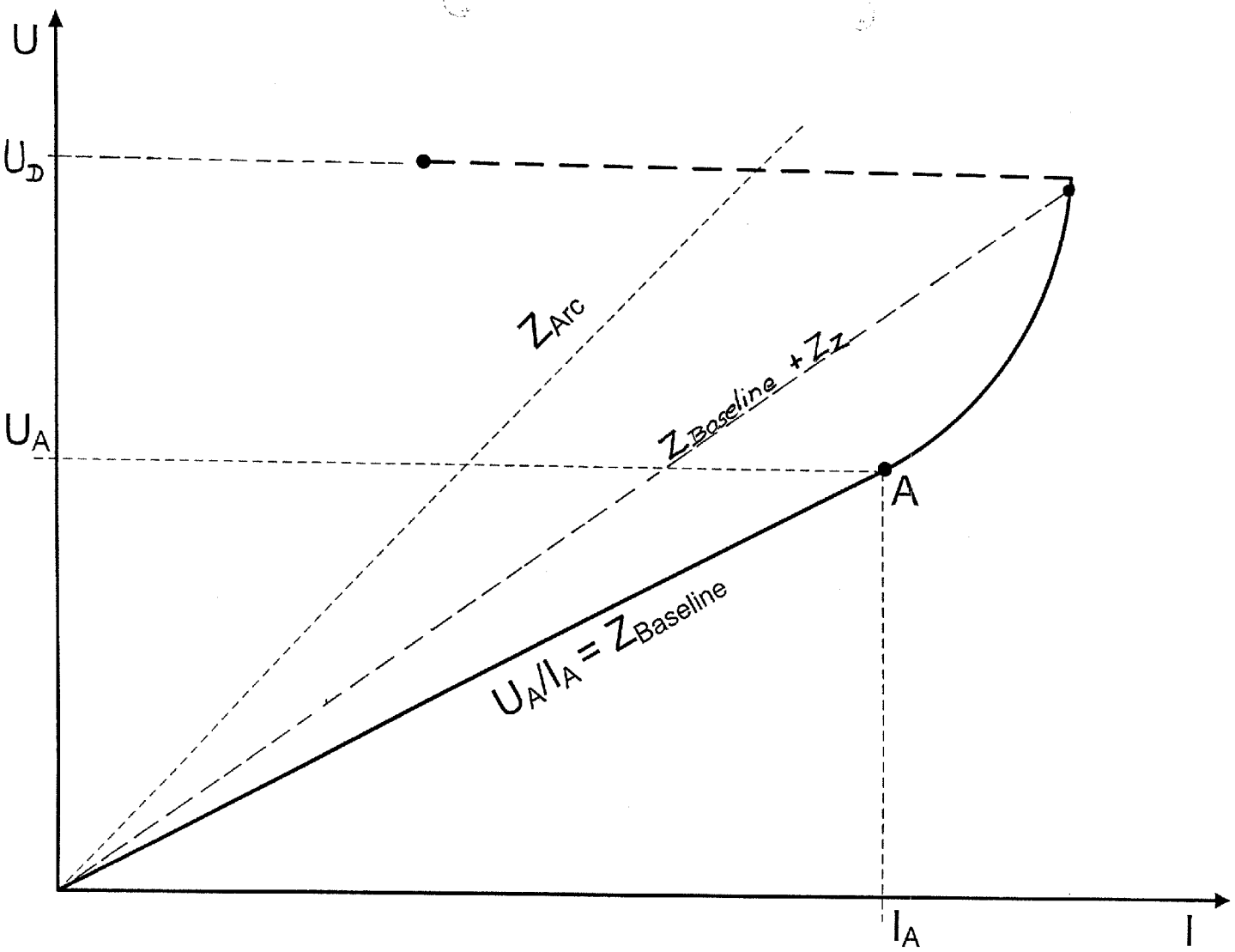
Figur 6

METHOD FOR IGNITING A FUEL/AIR MIXTURE OF A COMBUSTION CHAMBER, IN PARTICULAR IN AN INTERNAL COMBUSTION ENGINE, BY CREATING A CORONA DISCHARGE

BACKGROUND OF THE INVENTION

The invention is directed to a method having the features indicated in the preamble of claim 1. Such a method is known from WO 2010/011838 A1.

Document WO 2004/063560 A1 discloses how a fuel/air mixture can be ignited in a combustion chamber of an internal combustion engine by a corona discharge created in the combustion chamber. For this purpose an ignition electrode is guided through one of the walls, that are at ground potential, of the combustion chamber in an electrically insulated manner and extends into the combustion chamber, preferably opposite a reciprocating piston provided in the combustion chamber. In cooperation with the walls of the combustion chamber that are at ground potential and function as counter-electrode the ignition electrode constitutes a capacitance. The combustion chamber and the contents thereof act as a dielectric. Air or a fuel/air mixture or exhaust gas is located therein, depending on which stroke the piston is engaged in.

The capacitance is a component of an electric oscillating circuit which is excited using a high-frequency voltage created using a transformer having a center tap. The transformer interacts with a switching device which applies a specifiable DC voltage to the two primary windings, in alternation, of the transformer connected by the center tap. The secondary winding of the transformer supplies a series oscillating circuit comprising the capacitance formed by the ignition electrode and the walls of the combustion chamber. The frequency of the alternating voltage which excites the oscillating circuit and is delivered by the transformer is controlled such that it is as close as possible to the resonance frequency of the oscillating circuit. The result is a voltage step-up between the ignition electrode and the walls of the combustion chamber in which the ignition electrode is disposed. The resonance frequency is typically between 30 kilohertz and 3 megahertz, and the alternating voltage reaches values at the ignition electrode of 50 kV to 500 kV, for example.

A corona discharge can therefore be created in the combustion chamber. The corona discharge should not break down into an arc discharge or a spark discharge. Measures are therefore implemented to ensure that the voltage between the ignition electrode and ground remains below the voltage required for a complete breakdown. For this purpose, it is known from WO 2004/063560 A1 to measure the voltage and the current intensity at the input of the transformer and, on the basis thereof, to calculate impedance as the quotient of voltage and current intensity. The impedance calculated in this manner is compared to a fixed setpoint value for the impedance, which is selected such that the corona discharge can be maintained without the occurrence of a complete voltage breakdown.

This method has the disadvantage that the formation of the corona is not optimal and, in particular, an optimal size of the corona is not always attained. Specifically, the corona increases in size the closer the oscillating circuit is operated to the breakdown voltage. To ensure that the breakdown voltage is never reached, the setpoint value of the impedance that must not be exceeded must be so low that a voltage breakdown and, therefore, an arc of a spark, is always prevented. A point that must be considered when specifying the setpoint value of the impedance is that the current-voltage characteristic curve of the circuit driving the transformer is subject to production-related fluctuations. If structural or production-related changes are made to the circuit and the oscillating circuit that cause the current-voltage characteristic curve to change, it may be necessary to redetermine the setpoint value of the impedance using trials, to prevent the situation in which a corona of inadequate size is formed or, in the worst case, a corona is not formed at all.

On the basis of document WO 2010/011838 A1 it is known to control the transformer on the primary side thereof by specifying a setpoint impedance by first determining a so-called baseline impedance at the input of the transformer at a voltage that is so low that a corona discharge does not occur. Starting at a low voltage, the current-voltage characteristic curve at the input of the transformer initially has a linear shape, which indicates that impedance remains the same: The current intensity initially increases in proportion to voltage. The baseline impedance is characteristic for the particular igniter. If a certain voltage is exceeded, the impedance increases, which is indicated by the fact that the intensity of the current measured on the primary side of the transformer is no longer proportional to the voltage, but rather increases at an increasingly slower rate as the voltage continues to increase, until a voltage breakdown occurs between the ignition electrode and one of the walls delimiting the combustion chamber. In the method known from document WO 2010/011838 A1, the setpoint impedance is determined as the sum of the baseline impedance and an additional impedance. The additional impedance is increased in small increments by increasing the voltage until a spark discharge occurs. As soon as a spark discharge is detected, the additional impedance is reduced by an amount that is slightly greater than the preceding increment, in order to prevent further spark discharges and keep the oscillating circuit in resonance. It is therefore possible to hold the current intensity and voltage at the input of the transformer below the level at which a spark discharge can occur, and to limit them to a level at which the corona reaches a maximum size.

The impedance on the primary side of the transformer, at which a corona discharge occurs, and the impedance at which a corona discharge transitions into an unwanted arc discharge or spark discharge can change during the service life of the ignition electrode, which can be disadvantageous for the service life thereof and for the formation of the corona, and can result in non-ideal combustion.

BRIEF SUMMARY OF THE INVENTION

The object of the present invention is a method for igniting a fuel/air mixture in one or more combustion chambers using corona discharge, which allows for optimal formation of the corona and avoids the initially described disadvantages to the greatest extent possible.

This object is attained by way of a method having the features indicated in claim 1. Advantageous developments of the invention are the subject matter of the dependent claims.

In the method according to the invention for igniting a fuel/air mixture in a cyclically operating internal combustion engine having one or more combustion chambers delimited by walls that are at ground potential, using an ignition device comprising an ignition electrode provided in each combustion chamber, an electric oscillating circuit is excited using an electric DC/AC converter which, on the primary side thereof, has the baseline impedance which is characteristic for the existing ignition device of the internal combustion engine, the electric oscillating circuit being connected to the secondary side of the DC/AC converter. In the oscillating circuit, the ignition electrode—which is guided through one of the walls delimiting the combustion chamber in a manner in which it is electrically insulated from said walls by an insulator and extends into the combustion chamber—constitutes a capacitance in cooperation with the walls of the combustion chamber that are at ground potential. The excitation of the oscillating circuit is so controlled that a high-frequency corona discharge igniting the fuel/air mixture is created in each combustion chamber at the ignition electrode. Combustion residues that have deposited onto the surface of the insulator located in the combustion chamber are occasionally removed from the surface of the insulator in the combustion chamber, in particular via processes of combustion and/or electroerosion. Particularly preferably the combustion residues are removed by occasionally generating spark discharges or arc discharges in the environment of the ignition electrode in the combustion chamber.

It has been shown that, upon ignition of a fuel/air mixture in an internal combustion engine, combustion residues, in particular soot, can become deposited onto the insulator which extends into the combustion chamber of an internal combustion engine and insulates the ignition electrode with respect to the wall of the combustion chamber. These deposits can induce arcs from the tip of the ignition electrode to the insulator, or sliding discharges from the tip of the ignition electrode along the surface of the insulator to the combustion chamber wall, thereby preventing the formation of a corona between the ignition electrode and the piston head of a piston moving in the combustion chamber of the internal combustion engine. The result thereof can be non-ideal combustions, misfirings, or even the complete absence of ignition. The affected igniter, which is composed mainly of the ignition electrode, the insulator, and fastening means, must then be replaced by an igniter that is new and uncontaminated, or that has been cleaned, which is a laborious process and requires a visit to the repair facility.

In contrast, the invention has substantial advantages:

- Replacement of the igniter can be avoided or at least delayed.
- The service life of an igniter is extended.
- Deposits on the insulator can be removed without interrupting the operation of the engine.
- The cleaning process according to the invention can be carried out at such time intervals that substantial deposits on the insulator do not form at all.
- By using the method according to the invention, it is therefore possible to operate corona ignition in an approximately consistent, optimal manner.
- Non-ideal combustions, misfirings, and failures of the igniter can be prevented.

A transformer which comprises at least one primary winding on the primary side thereof, and, on the secondary side thereof, a secondary winding that supplies the oscillating circuit is suited in particular for use as the DC/AC converter. Advantageously, an alternating voltage is generated using the transformer which comprises, on the primary side thereof, two primary windings which have a common center tap, see WO 2004/063560 A1. The desired high voltage need not be generated using a transformer, however, but rather can be generated using a DC/AC converter which is supplied on the input side thereof—which is also referred to here as primary side—with a DC voltage—which is also referred to here as primary voltage—thereby directly generating a high-frequency alternating high voltage using known solid-state circuits, e.g. using an H bridge circuit which comprises an HF circuit breaker on a semiconductor base in each of the four branches thereof, it being possible to tap the high and high-frequency alternating voltage on the output side—which is also referred to here as secondary side—of the DC/AC converter.

There are different ways to determine when and under which conditions a cleaning procedure should be initiated. In this particular case, a cleaning procedure means removing combustion residues from the surface of the insulator located in the combustion chamber using processes of combustion and/or electroerosion, in particular by occasionally generating spark discharges or arc discharges in the environment of the ignition electrode and/or by temporarily enriching the fuel/air mixture with additional fuel and/or by deliberately wetting the surface of the insulator with fuel. These measures, which can be applied individually or in combination, make it possible to remove combustion residues that have deposited on the surface of the insulator located in the combustion chamber. A criterium for deciding when such a cleaning procedure is suitable, advisable, or necessary can be formulated on the basis of empirical values. Such empirical values can be obtained in particular by observing the impedance which can be measured on the primary side of the transformer or an other DC/AC converter. Instead of impedance, a variable or magnitude derived from the impedance can be observed to determine whether or when a criterium—which has been formulated on the basis of empirical values—for triggering a cleaning procedure is present.

One way is to observe changes in impedance, which occur over time, on the primary side of the DC/AC converter, and to decide—on the basis of the observed changes in impedance or on the basis of the observed change of a variable or magnitude derived from the impedance, by comparison with a specified threshold value of the change—whether or when to trigger a cleaning procedure in a combustion chamber.

If spark discharges or arc discharges should be created for the cleaning procedure, it is advantageous in terms of high efficacy of the cleaning procedure to apply a voltage between the ignition electrode, which is guided through the insulator, and one of the walls of the combustion chamber that are at ground potential, which is not merely higher than the instantaneous breakdown voltage which applies for the insulator contaminated with combustion residues. Instead, the voltage should be so high that a spark discharge or arc discharge takes place even when the surface of the insulator located in the combustion chamber is clean. It can then be ensured that the cleaning procedure actually results in a clean surface of the insulator. The high-energy arcs of a spark cause combustion or the removal (electroerosion) of deposits on the insulator. Subsequent thereto, the ignition device can be operated in an optimal manner once more.

Instead of generating a spark discharge or an arc discharge in the environment of the ignition electrode in order to clean the insulator, conditions can be created in another manner which result in combustion of the combustion residues that have deposited onto the insulator. One way is to shift the operating point of the internal combustion engine, i.e. to temporarily introduce a richer fuel/air mixture into the combustion chamber, which, due to the increased fuel-to-air ratio, results in higher combustion temperatures in the combustion chamber, which eventually cause the combustion residues to be burned off of the insulator.

Another way is to wet the surface of the insulator with fuel during the cleaning procedure, thereby subsequently resulting in more intensive combustion locally in the region of the ignition electrode of the contaminated surface of the insulator, and resulting in a higher combustion temperature, thereby eventually causing the deposits to be burned off of the surface of the insulator.

To intensify and shorten the cleaning procedure, the various possibilities for removing deposits from the surface of the insulator can be combined with one another.

If combustion residues deposit on the surface of the insulator located in the combustion chamber, the impedance to be measured on the primary side of the DC/AC converter increases relative to the same primary voltage. Therefore, a suitable criterium for triggering a cleaning procedure is to observe the impedance on the primary side of the DC/AC converter and to trigger the cleaning procedure when the impedance which is measured at a specified primary voltage exceeds a specified threshold value. This threshold value can be determined as an empirical value and should be so high that accidental increases in the impedance that is measured never trigger a cleaning procedure.

The specified primary voltage at which the impedance and the changes thereof are measured on the primary side of the DC/AC converter is so selected that it is lower—preferably slightly lower—than the value of the primary voltage at which a corona discharge occurs when the surface of the insulator located in the combustion chamber is free of deposits. As known from WO 2010/011838 A1, FIG. 5, for example, the primary current of the transformer, which is used as DC/AC converter in that case, initially increases linearly as primary voltage increases; the characteristic curve which indicates the dependence of the primary current on the primary voltage is a line, the slope of which is the impedance. The slope of said characteristic curve increases as the corona discharge occurs. It is recommended that the impedance be observed at a primary voltage which is still located in the straight region of the primary current/primary voltage characteristic curve, preferably slightly below the point at which the slope of the characteristic curve and, therefore, the impedance, increases. If this is done, then the observation of an increase in impedance on the primary side of the DC/AC converter clearly correlates with increasing contamination of the insulator for the ignition electrode.

If the deposition of combustion residues on the insulator of the ignition electrode reduces the breakdown voltage to such a great extent that it drops to or below the specified primary voltage at which a corona discharge still does not occur when the insulator is clean, and which is used as reference voltage at which the baseline impedance is measured for impedance comparisons, then this can also be used as a criterium for triggering a cleaning procedure, because, when a voltage breakdown occurs, the primary current decreases rapidly while primary voltage remains the same, as illustrated in FIG. 5 of WO 2010/011838 A1, and this rapid decrease simultaneously means that the impedance to be measured on the primary side of the DC/AC converter increases rapidly.

When a fuel/air mixture is ignited in an internal combustion engine using a corona discharge, the objective is to obtain the largest possible corona. This is obtained by approaching the breakdown voltage as closely as possible. One way to achieve this is disclosed in WO 2010/011838 A1, and is described in the introduction to the present patent application: In the method known from WO 2010/011838 A1, the setpoint impedance at which ignition is supposed to occur is determined as the sum of the baseline impedance and an additional impedance. The additional impedance is increased in small increments by increasing the voltage until a spark discharge occurs. As soon as a spark discharge is detected, the additional impedance is reduced by an amount that is slightly greater than the preceding increment, in order to prevent further spark discharges and keep the oscillating circuit in resonance. It is therefore possible to hold the primary current intensity and the primary voltage at the input of the transformer or another DC/AC converter below the level at which a spark discharge can occur, and to limit them to a level at which the corona reaches a maximum size.

Other methods for determining the setpoint impedance such that the corona discharge is generated slightly below the breakdown voltage are disclosed in German patent application 10 2010 020 469.2 and in German patent application 10 2010 015 344.3.

In particular, it is possible to ensure that the corona discharge is generated slightly below the breakdown voltage by increasing the electrical primary voltage applied to the primary side of the DC/AC converter incrementally before every moment of ignition of the internal combustion engine, wherein the increments by which the primary voltage is increased are selected such that the intensity of the primary current flowing on the primary side increases incrementally due to the stepwise increase in the applied primary voltage by amounts that become smaller as the impedance at the input point of the DC/AC converter increases, and moves toward a specifiable minimum upon approaching the breakdown voltage. The increases in the primary current converge toward this specifiable minimum, and once the objective of convergence has been reached, the voltage between the ignition electrode and the surrounding combustion chamber wall is slightly less than the breakdown voltage.

It has been shown that breakdown voltage decreases as contamination of the insulator of the ignition electrode with combustion residues increases. Therefore, the decrease in breakdown voltage that is observed can also be used as a criterium for determining when a cleaning procedure is triggered, i.e. advantageously when the breakdown voltage drops below a threshold value which can be defined on the basis of empirical values.

If the breakdown voltage decreases, the primary voltage at which the corona discharge can be generated slightly below the breakdown voltage must also decrease. If the setpoint impedance at which the corona discharge is supposed to be generated slightly below the breakdown voltage is determined using the method disclosed in WO 2010/011838 A1, then the setpoint impedance decreases together with the breakdown voltage. Therefore, another suitable criterium for triggering a cleaning procedure is when the setpoint impedance at which the corona discharge is generated slightly below the breakdown voltage, and which can be measured on the primary side of the DC/AC converter, falls below a threshold value. Starting at the baseline impedance which is measured when the insulator is clean, the additional impedance to be added to the baseline impedance decreases as the contamination level of the insulator increases, to determine a setpoint impedance that is slightly less than the breakdown voltage as the contamination level of the insulator increases. A cleaning procedure can therefore also be triggered whenever the additional impedance to be added to the baseline impedance determined when the insulator was clean, in order to determine a setpoint impedance at which the corona discharge is generated slightly below the breakdown voltage, falls below a threshold value formed on the basis of empirical values.

Another way to form a criterium for deciding whether to trigger a cleaning procedure by observing impedances on the primary side of the DC/AC converter is to observe the impedances on the primary side of the DC/AC converter at which a spark discharge has not quite yet occurred, that is, at which the corona discharge is generated slightly below the breakdown voltage, and to observe how this impedance changes with the distance between the tip of the ignition electrode and the piston of the internal combustion engine moving in the combustion chamber. The difference between the lowest impedance that is observed and the greatest impedance that is observed will be greater when the insulator is clean than when the insulator is contaminated with combustion residues. In the case of a contaminated insulator, arcs of a spark are usually directed toward the insulator body, and so the distance of the tip of the ignition electrode from the piston head has less of an effect on the impedance. If the difference between the greatest impedance that was observed and the lowest impedance that was observed therefore falls below a threshold value formed on the basis of empirical values, this is an indication that the insulator is contaminated with combustion residues, and is suitable for use as a criterium for triggering a cleaning procedure.

Instead of observing the development of the impedance that can be measured on the primary side of the DC/AC converter, a cleaning procedure can also be triggered when the number of spark discharges detected in a combustion chamber within a certain time period exceeds a threshold value, because this is a sign that the breakdown voltage has been reduced, which may be caused in particular by contamination of the insulator with combustion residues.

Another meaningful way to trigger a cleaning procedure is to specify a time period and trigger a cleaning procedure when the specified time period since the last cleaning procedure has passed. It is even better to specify not only a time period, but also an engine run time that has passed since the last cleaning procedure, or a number of engine cycles—e.g. a specified number of revolutions of the crankshaft—and to trigger a cleaning procedure when the specified engine run time since the last cleaning procedure has passed, or when the specified number of engine cycles has been reached. In the latter cases in particular, the cleaning procedure can also be triggered by a control signal transmitted by the engine control unit. The engine control unit can then also trigger a cleaning procedure when an analysis of the combustion process carried out by the engine control unit gives reason to suspect that the combustion process is not longer taking place in an optimal manner, and the cause thereof may be contamination of the insulator of the corona igniter.

The duration of the cleaning procedure can be made dependent on the criterium which has initiated or triggered the cleaning procedure. It can also be dependent on the intensity of the cleaning procedure. If the criterium which triggers the cleaning procedure indicates e.g. that strong contamination must be present, because several unwanted arcs of sparks instead of corona discharges have occurred, then an extended cleaning procedure can be implemented in this case.

The duration of the cleaning procedure can be specified in different units, either as an absolute time period by specifying a certain number of milliseconds, or by specifying an angle through which the crankshaft of the engine should rotate during the cleaning procedure, wherein said angle can also be a plurality of crankshaft revolutions. Finally, the duration of the cleaning procedure can also be indicated by a number of engine cycles across which the cleaning procedure should extend.

Advantageously, the cleaning procedure is not carried out during the entire engine cycle, but rather during a period of the engine cycle that is particularly suitable for the cleaning procedure, in particular before the actual moment of ignition or after the actual moment of ignition, but preferably not during the moment of ignition. Excepting the moment of ignition from the cleaning procedure has the advantage that the cleaning procedure and the normal combustion phase of the engine can be superimposed onto one another, thereby ensuring that engine operation is disrupted by the cleaning procedure as little as possible.

Instead of a specified number of engine cycles or a specified number of crankshaft revolutions or a specified crankshaft angle or a specified time period for the cleaning procedure, it is also possible to implement the cleaning procedure in as many consecutive engine cycles as there are engine cycles in which the criterium for triggering the cleaning procedure is met.

Finally, in order to determine the duration of the cleaning procedure, it is also possible to combine the possibilities for specifying a fixed time period or a fixed crankshaft angle or a fixed number of engine cycles with the orientation as to whether the criterium for triggering a cleaning procedure is still met. If these combinations are combined with one another, the cleaning procedure continues for as long as the triggering criterium is met, for instance, but for at least as long as the specified number of engine cycles or a specified time period, or at least until a specified crankshaft angle has been reached. Finally, it is also possible to specify a time window for the cleaning procedure and to terminate the cleaning procedure within this time window if the criterium for implementing the cleaning procedure is no longer met.

The suitable requirements for the duration of the cleaning procedure can be determined in advance in trials conducted for a certain engine type, and are then available as empirical values.

In addition to an ignition control unit provided separately for the ignition device, the engine control unit which is provided anyway in motor vehicles can be incorporated into the control of the cleaning procedures. For example, the ignition control unit, which continuously monitors the contamination level of the insulator, can transmit appropriate status signals containing information on the contamination level to the engine control unit which then shifts the operating point on the internal combustion engine depending on the contamination level that was reported in order to initiate cleaning of the insulator, or to initiate a specific wetting of the insulator with fuel, for instance, to thereby trigger a cleaning of the insulator in subsequent combustion. Finally, the engine control unit can also ensure e.g. that the cleaning procedure is carried out every time engine operation ends, e.g. in that when actuation of the ignition key triggers a signal to shut off the engine, the engine control unit initiates an after-run phase of the engine if the ignition control unit reported that a criterium for triggering a cleaning procedure exists, and said cleaning procedure can then take place in the after-run phase.

The aforementioned criteria for triggering a cleaning procedure can be applied individually or in combination. If at least two criteria for deciding whether to trigger a cleaning procedure are applied, then the cleaning procedure is preferably triggered as soon as a first criterium has been met.

BRIEF DESCRIPTION OF THE DRAWINGS

The invention is explained in greater detail below with reference to the attached schematic drawings.

FIG. 3 shows the U/I characteristic curve at the input point of the transformer during normal operation of the igniter having a clean insulator, and is used to illustrate the determination of the baseline impedance at an igniter having a contaminated insulator, FIG. 4 shows a U/I characteristic curve at the input point of transformer 12 during normal operation of the igniter having a clean insulator, and is used to illustrate the determination of a setpoint impedance on the basis of the baseline impedance and an additional impedance in the case of a clean insulator and a contaminated insulator.

FIG. 5 shows a U/I characteristic curve at the input point of transformer 12 during normal operation of the igniter having a clean insulator, and is used to illustrate how the setpoint impedance can vary at different ignition angles, and FIG. 6 shows a U/I characteristic curve at the input point of transformer 12 during normal operation of the igniter having a clean insulator, and is used to illustrate the case in which, when an insulator is contaminated, the breakdown voltage decreases greatly and the impedance on the primary side of the transformer increases greatly.

DETAILED DESCRIPTION OF THE INVENTION

Figure 1:
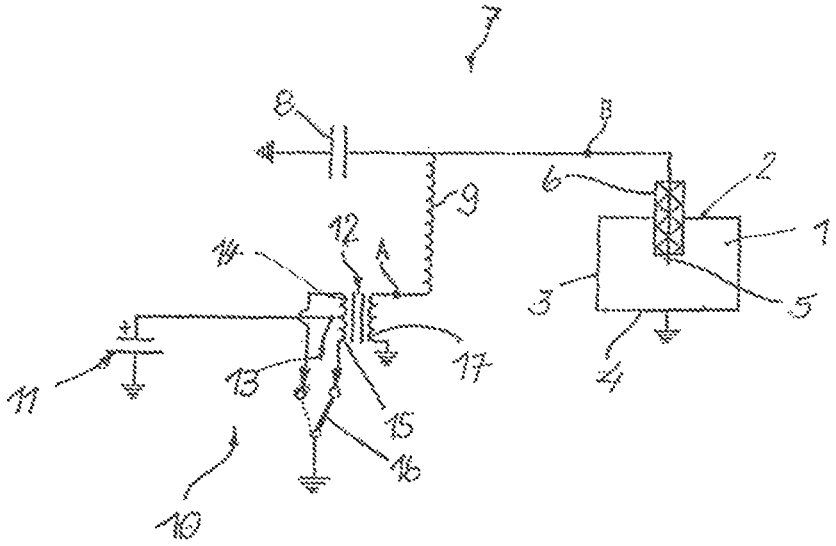
FIG. 1 shows a schematic depiction of the design of an ignition system for a vehicle engine.

FIG. 1 shows a combustion chamber 1 which is delimited by walls 2, 3, and 4 that are at ground potential. An ignition electrode 5 which is enclosed by an insulator 6 along a portion of the length thereof extends into combustion chamber 1 from above, and is guided through upper wall 2 into combustion chamber 1 in an electrically insulated manner by way of said insulator. Ignition electrode 5 and walls 2 to 4 of combustion chamber 1 are part of a series oscillating circuit 7 which also includes a capacitor 8 and an inductor 9. Of course, series oscillating circuit 7 can also comprise further inductors and/or capacitors, and other components that are known to a person skilled in the art as possible components of series oscillating circuits.

A high-frequency generator 10 is provided for excitation of oscillating circuit 7, and comprises a DC voltage source 11 and a transformer 12, as DC/AC converter, having a center tap 13 on the primary side thereof, thereby enabling two primary windings 14 and 15 to meet at center tap 13. Using a high-frequency switch 16, the ends of primary windings 14 and 15 opposite center tap 13 are connected to ground in alternation. The switching rate of high-frequency switch 16 determines the frequency with which series oscillating circuit 7 is excited, and can be changed. Secondary winding 17 of transformer 12 supplies series oscillating circuit 7 at point A. High-frequency switch 16 is controlled using a not-shown control loop such that the oscillating circuit is excited with the resonant frequency thereof.

The voltage between the tip of ignition electrode 5 and walls 2 to 4 that are at ground potential is therefore at a maximum.

Figure 2:
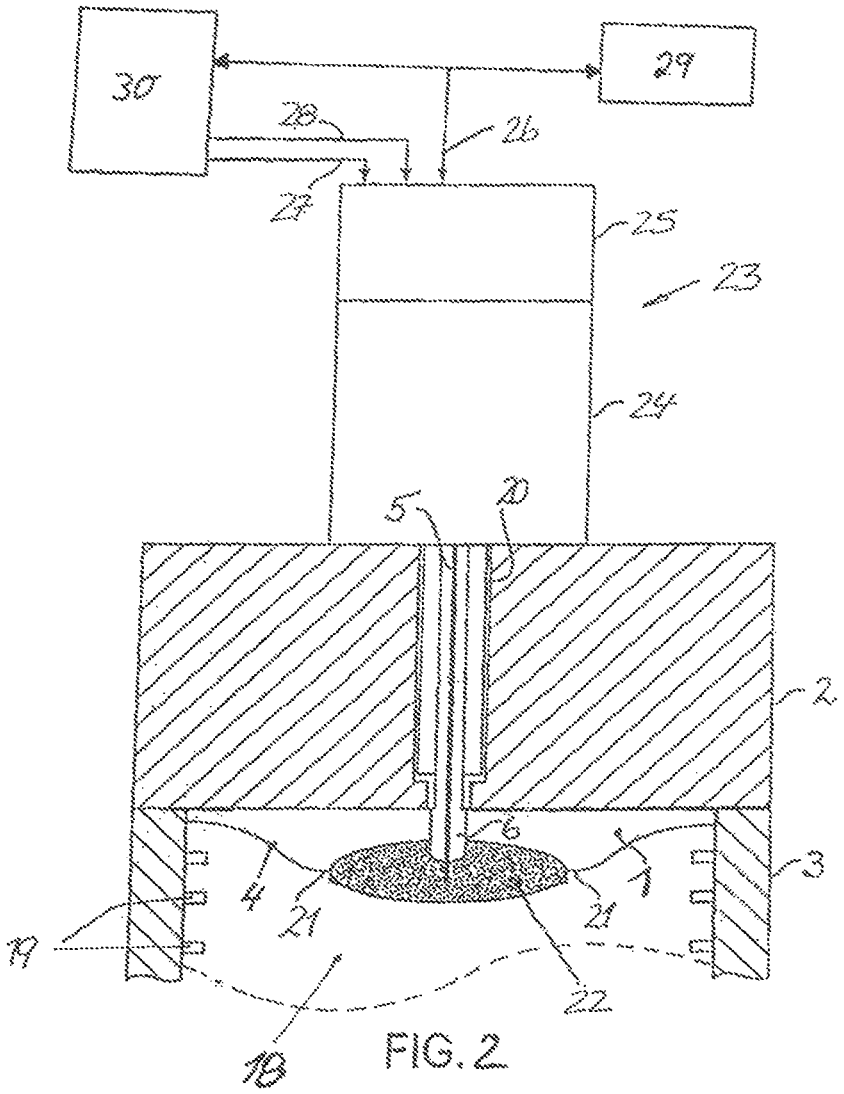
FIG. 2 shows the longitudinal cross section of a cylinder of an internal combustion engine, which is connected to the ignition system shown in FIG. 1.

FIG. 2 shows a longitudinal cross section of a cylinder of an internal combustion engine equipped with the ignition device depicted schematically in FIG. 1. Combustion chamber 1 is limited by an upper wall 2 in the form of a cylinder head, a cylindrical circumferential wall 3, and top side 4 of a piston 18 which is equipped with piston rings 19 and can move back and forth in the cylinder.

Cylinder head 2 comprises a passage 20 through which ignition electrode 5 is guided in an electrically insulated and sealed manner. Ignition electrode 5 is enclosed along a portion of the length thereof by an insulator 6 which can be composed of a sintered ceramic, e.g. an aluminium oxide ceramic. Ignition electrode 5 extends via the tip thereof into combustion chamber 1 and extends slightly past insulator 6, although it could be flush therewith.

When oscillating circuit 7 is excited, a corona discharge forms between ignition electrode 5 and piston 18, and is accompanied by a more or less intensive charge carrier cloud 22.

A housing 23 is placed onto the outer side of cylinder head 2. Primary windings 14 and 15 of transformer 12, and high-frequency switch 16 interacting therewith, are located in a first compartment 24 of housing 23. A second compartment 25 of housing 23 contains secondary winding 17 of transformer 12 and the remaining components of series oscillating circuit 7, and, optionally, means for observing the behavior of oscillating circuit 7. An interface 26 can be used to establish a connection, for example, to a diagnostic unit 29 and/or an engine control unit 30. However, transformer 12 does not necessarily have to be accommodated in a housing mounted on cylinder head 2, but rather can be located together with high-frequency switches 16 in a separate ignition control unit which, in turn, can be connected to engine control unit 30. The remaining parts of the series oscillating circuit can be located in a housing which encloses insulator 6.

FIG. 3 shows the U/I characteristic curve at the input point of transformer 12, as a solid line. Given an uncontaminated insulator 6, the baseline impedance $Z_{Baseline}$ is determined by applying a voltage $U_A$ to a primary winding of the transformer, as follows:

$$Z_{Baseline}=U_A/I_A$$

The primary voltage $U_A$ is selected such that normally neither a corona nor a spark discharge occurs, i.e. point A is still located on the straight section of the characteristic curve. The voltage $U_A$ is substantially lower than the primary voltage $U_D$ at which a voltage breakdown would occur between ignition electrode 5 and a wall of combustion chamber 1. If spark discharges occur already at low voltage $U_A$ when insulator 6 is contaminated, then a substantially greater impedance is measured at voltage $U_A$ $$Z_{AV}=U_A/I_{AV},$$

in which the index V stands for "contaminated". Since spark discharges occur due to the insulator being contaminated, a cleaning procedure should be initiated. To this end a threshold value $Z_R$ for the impedance is provided, which is lower than the impedance $Z_{AV}$, but is clearly greater than the baseline impedance $Z_{Baseline}$, and, in fact is so great that the dashed line—the slope of which represents the threshold value $Z_R$—does not intersect the solid section of the characteristic curve of the uncontaminated ignition device, but rather the dashed section which indicates the voltage breakdown for uncontaminated insulator 6.

Advantageously, the threshold value $Z_R$ is determined in preliminary trials conducted for a certain engine type, and must be high enough that fluctuations of the baseline impedance due to production tolerances, temperature differences, or changes in an ignition control device provided for the corona ignition device do not cause the cleaning procedure to be initiated.

FIG. 4 shows the U/I characteristic curve, as a solid line, at the input point of transformer 12 for an uncontaminated igniter having the baseline impedance $$Z_{Baseline}=U_A/I_A.$$

Point A at which the baseline impedance is determined is still located on the straight part of the characteristic curve in this case. A setpoint impedance at which the corona discharge should be created if the igniter is uncontaminated is determined by adding an additional impedance $Z_Z$ to the baseline impedance ($Z_{Baseline}$):

$$Z_{soll}Z_{Baseline}+Z_Z.$$

The dashed line, the slope of which represents the impedance $Z_{Baseline}+Z_Z$, intersects the U/I characteristic curve slightly below the point at which a voltage breakdown would occur between the ignition electrode and a combustion chamber wall. The voltage breakdown occurs at a primary voltage $U_D$.

If the insulator is contaminated, the breakdown voltage decreases, and so does the impedance of the ignition device having the contaminated insulator slightly below the breakdown voltage which is then present, e.g. the impedance $Z_{Baseline}+Z_{ZV}$ that applies for the contaminated case. The impedance $Z_{Baseline}+Z_{ZV}$ for the contaminated insulator can be determined as setpoint impedance in the same manner as for the case of the uncontaminated insulator, e.g. using the method disclosed in WO 2010/011838 A1. According to said method, the additional impedance $Z_{ZV}$ is determined by increasing the primary voltage in small increments if spark discharges are absent for a long period of time, and, when a spark discharge is detected, the primary voltage is reduced by an amount that is greater than that by which it was increased in the last step. The setpoint impedance $Z_{Baseline}+Z_{ZV}$ determined in this manner is then applied for the case of a contaminated insulator in order to operate the igniter, even if contaminated, at a working point on the U/I characteristic curve that is slightly lower than the occurrence of spark discharges. To trigger a cleaning procedure, the impedance $Z_{Baseline}+Z_{ZV}$ that exists in the presence of contamination is compared to a threshold value $Z_{Baseline}+Z_{ZR}$, and if the additional impedance $Z_{ZV}$ is less than $Z_{ZR}$, a cleaning procedure is triggered.

Instead of working with a threshold value $Z_{Baseline}$ $Z_{ZR}$, below which a cleaning procedure is triggered, it is also possible to utilize a corresponding limit value $I_{Grenz}$ of the current intensity, below which a cleaning procedure is triggered. FIG. 4 shows one possible location of $I_{Grenz}$.

The threshold value $Z_{ZR}$ can be determined in preliminary trials conducted for a certain engine type, and must be small enough that fluctuations of the additional impedance due to production tolerances do not yet trigger a cleaning procedure.

FIG. 5 shows, as a solid line, the U/I characteristic curve of the ignition device for the case of an uncontaminated insulator 6. The moment of ignition (ignition angle) of an internal combustion engine can be changed by an engine control unit. Different breakdown voltages are obtained for different ignition angles, i.e. for different distances between ignition electrode 5 and piston 18. Thus, different setpoint impedances should be selected for different ignition angles in order to obtain a corona of optimal size. Given a larger ignition angle, i.e. a greater distance between ignition electrode 5 and piston 18, a higher breakdown voltage typically occurs, and therefore so does a greater additional impedance $Z_Z$, since the distance between ignition electrode 5 and the head of piston 18 is greater than it is at a smaller ignition angle, thereby making it possible to generate a larger corona without the arc of a spark. The size of the corona increases with the additional impedance $Z_Z$.

Typically, fifteen different additional impedances $Z_Z$ are determined for an ignition angle range of 0° to 45°. The difference between the greatest and the least additional impedance $Z_Z$ is now greater with an uncontaminated insulator 6 than it is with a contaminated insulator, since, given a contaminated insulator 6, the arcs of sparks are usually directed from the tip of ignition electrode 5 to insulator 6, and therefore a distance between ignition electrode 5 and piston 18 has less of an effect on the magnitude of the additional impedance $Z_Z$ than in the case of an uncontaminated insulator 6. In the case of a contaminated insulator 6, the additional impedances can therefore have approximately the same value for various ignition angles, i.e. the difference between the least additional impedance and the greatest additional impedance which can occur at the various ignition angles is relatively small. If it is therefore determined that the difference between the greatest additional impedance and the least additional impedance is smaller than in the case of an uncontaminated insulator 6, and it falls below a specified threshold value, then this is a suitable criterium for triggering a cleaning procedure. The threshold value is determined once more in preliminary trials conducted for a certain engine type.

Using a contaminated insulator 6 as an example, FIG. 5 shows the greatest setpoint impedance $Z_{Baseline}+Z_{ZV\,Max}$ and the lowest setpoint impedance $Z_{Baseline}+Z_{ZV\,Min}$ which were determined for the different ignition angles. The difference is $Z_{ZV\,Max}-Z_{ZV\,Min}$, which is compared to the threshold value obtained in preliminary trials. If the difference $Z_{ZV\,Max}-Z_{ZV\,Min}$ is less than the threshold value, a cleaning procedure is triggered.

FIG. 6 shows the U/I characteristic curve, once more, at the input point of transformer 12, and a specified fixed impedance threshold value $Z_{Arc}$ for the detection of a spark discharge according to the method disclosed in WO 2010/011838 A1. A spark discharge is considered to have been detected when the impedance measured on the primary side of transformer 12 exceeds the threshold value $Z_{Arc}$, which is shown in FIG. 6 as the intersection point of the line, the slope of which represents $Z_{Arc}$, and the dashed section of the characteristic curve, which represents the occurrence of an arc of a spark. The threshold value $Z_{Arc}$ should be selected such that a spark discharge is reliably detected. The situation should be avoided in which the threshold value of the impedance $Z_{Baseline}+Z_Z$ is reduced even when the corona is normal because a spark discharge was apparently detected even though a spark discharge did not actually occur.

LIST OF REFERENCE NUMERALS

1. Combustion chamber
2. Wall
3. Wall
4. Wall
5. Ignition electrode
6. Insulator
7. Oscillating circuit
8. Capacitor
9. Inductor
10. High-frequency generator
11. DC voltage source
12. DC/AC converter
13. Center tap
14. Primary winding
15. Primary winding
16. High-frequency switch
17. Secondary winding
18. Piston
19. Piston ring
20. Passage
21. ---
22. Charge carrier cloud
23. Housing
24. Compartment
25. Compartment
26. Interface
27. ---
28. ---
29. Diagnostic unit
30. Engine control unit
FIGS. 4 and 5:

| DE | EN |
|---|---|
| Soll | setpoint |
| Arbeitspunkt | working point |
| Grenz. | limit value |

What is claimed is:

1. A method for igniting a fuel/air mixture in a cyclically operating internal combustion engine comprising one or more combustion chambers which are delimited by walls that are at ground potential, using an ignition device comprising an ignition electrode provided in each combustion chamber, in which method, by way of an electrical DC/AC converter, comprising the steps of exciting an electric oscillating circuit, which is connected to a secondary side of the DC/AC converter, and in which the ignition electrode, which is guided through one of a wall delimiting the combustion chamber in a manner in which it is electrically insulated from said walls by an insulator and extends into the combustion chamber, constitutes a capacitance in cooperation with the walls of the combustion chamber that are at ground potential, and controlling the step of excitation of the oscillating circuit such that a corona discharge igniting a fuel/air mixture is created in each combustion chamber at the ignition electrode, wherein combustion residues that have deposited onto a surface of the insulator located in the combustion chamber are removed from the surface of the insulator in the combustion chamber, using steps of combustion, comprising the step of temporarily enriching the fuel/air mixture with additional fuel, wherein a cleaning procedure is triggered when the number of spark discharges detected in a combustion chamber within a certain period of time exceeds a threshold value.

2. The method according to claim 1, wherein a step of establishing a criterion for deciding when a cleaning procedure—in which combustion residues that have deposited onto the surface of the insulator located in the combustion chamber are removed using processes of combustion—is formulated on the basis of a step of evaluating empirical values.

3. The method according to claim 1, wherein the criterion is obtained by the step of observing changes in the impedance characteristics on a primary side of the DC/AC converter.

4. The method according to claim 1, comprising the step of observing and evaluating changes in the impedance on the primary side of the DC/AC converter, which occur over time, and making a decision on the basis of the observed changes in impedance characteristics by comparison with a specified threshold value, and deciding when to trigger a cleaning procedure in a combustion chamber to remove combustion residues that have deposited onto the insulator's surface located in the combustion chamber.

5. The method according to claim 1, comprising the step of removing combustion residues that have deposited on the insulator's surface located in the combustion chamber by creating arc discharges when the impedance on the primary side of the DC/AC converter as measured at a specified primary voltage ($U_A$) exceeds a specified threshold value.

6. The method according to claim 5, wherein the specified primary voltage ($U_A$) is selected such that it is less than, in particular slightly less than the value of the primary voltage at which a corona discharge occurs when the surface of the insulator located in the combustion chamber is free of deposits, and at which the impedance increases as the primary voltage increases.

7. The method according to claim 5, comprising the step of removing deposits of combustion residues from the surface of the insulator located in the combustion chamber by generating arc discharges when, due to the deposition of the combustion residues on the insulator, the occurrence of spark discharges is detected at the specified primary voltage (UA) at which a baseline impedance ($Z_{Baseline}$), which is characteristic for the existing ignition device of the internal combustion engine, was measured on the primary side of the DC/AC converter, and at which characteristic baseline impedance ($Z_{Baseline}$) a corona discharge would not yet occur when the insulator is clean.

8. The method according to claim 1, comprising the step of observing the breakdown voltage and triggering a cleaning procedure when either the breakdown voltage falls below a threshold value or when a setpoint value of the impedance, which can be measured on the primary side of the DC/AC converter and at which the corona discharge is generated below the breakdown voltage, falls below a threshold value.

9. The method according to claim 1, comprising the step of triggering a cleaning procedure when an additional impedance to be added to a certain baseline impedance ($Z_{Baseline}$) determined for the clean insulator, in order to determine a setpoint impedance at which the corona discharge is generated below the breakdown voltage, falls below a threshold value wherein the baseline impedance ($Z_{Baseline}$) was determined on the primary side of the DC/AC converter and is characteristic for the ignition device present in the internal combustion engine.

10. The method according to claim 1, comprising the step of triggering a cleaning procedure to remove combustion residues from the insulator when the amounts by which the impedances, measured on the primary side of the DC/AC converter either at different ignition angles or at different distances, at which a spark discharge does not occur, between a piston, which can move in the combustion chamber, and the tip of the ignition electrode differ by a maximum extent, fall below a threshold value.

11. The method according to claim 1, comprising the step of incrementally increasing before every moment of ignition of the internal combustion engine, the electric voltage (U) applied at a primary side of the DC/AC converter-here referred to as primary voltage—wherein the increments by which the primary voltage (U) is increased are selected such that the intensity of the electric current (I) flowing on the primary side-referred to hereinbelow as primary current—increases incrementally due to the stepwise increase in the applied primary voltage (U) by amount that become smaller as the impedance at the input of the DC/AC converter increases, and move toward a specifiable minimum upon approaching a voltage at which a voltage breakdown-referred to here as breakdown voltage (UD)—occurs in the oscillating circuit.

12. The method according to claim 1, comprising the step of triggering a cleaning procedure when either a predetermined time period or engine run time since the last cleaning procedure has passed, or when a predetermined number of engine cycles has been reached.

13. The method according to claim 1, comprising the step of generating arc discharges in the area surrounding the ignition electrode in the combustion chamber.

14. The method according to claim 4, comprising the step of applying a voltage to remove combustion residues from the insulator, between the ignition electrode, which is guided through the insulator, and one of the walls of the combustion chamber that are at ground potential, which voltage is higher than the breakdown voltage such that a spark discharge or an arc discharge occurs even if the surface of the insulator located in the combustion chamber is clean.

15. The method according to claim 1, comprising the step of triggering a cleaning procedure by a control signal transmitted by an engine control unit.

16. The method according to claim 1, comprising the step of triggering a cleaning procedure if at least two criteria for deciding whether to trigger a cleaning procedure are applied, as soon as a first criterion has been met.

17. The method according to claim 1, comprising the step of using a transformer as DC/AC converter which has at least one primary winding on the primary side thereof and one secondary winding on the secondary side thereof.

18. A method for igniting a fuel/air mixture in a cyclically operating internal combustion engine comprising one or more combustion chambers which are delimited by walls that are at ground potential, using an ignition device comprising an ignition electrode provided in each combustion chamber, comprising the step of exciting, by way of an electrical DC/AC converter, an electric oscillating circuit which is connected to a secondary side of the DC/AC converter, and in which the ignition electrode, which is guided through one of the walls delimiting the combustion chamber in a manner in which it is electrically insulated from said walls by an insulator and extends into the combustion chamber, constitutes a capacitance in cooperation with the walls of the combustion chamber that are at ground potential, and controlling the excitation of the oscillating circuit such that a corona discharge igniting the fuel/air mixture is created in each combustion chamber at the ignition electrode, removing combustion residues that have deposited onto the surface of the insulator located in the combustion chamber from the surface of the insulator in the combustion chamber, in particular using processes of combustion, comprising the step of temporarily enriching the fuel/air mixture with additional fuel, wherein the breakdown voltage is observed and a cleaning procedure is triggered when the breakdown voltage falls below a threshold value.

19. A method for igniting a fuel/air mixture in a cyclically operating internal combustion engine comprising one or more combustion chambers which are delimited by walls that are at ground potential, using an ignition device comprising an ignition electrode provided in each combustion chamber, comprising the step of exciting, by way of an electrical DC/AC converter, an electric oscillating circuit, which is connected to a secondary side of the DC/AC converter, and in which the ignition electrode which is guided through one of the walls delimiting the combustion chamber in a manner in which it is electrically insulated from said walls by an insulator and extends into the combustion chamber, constitutes a capacitance in cooperation with the walls of the combustion chamber that are at ground potential, and controlling the excitation of the oscillating circuit such that a corona discharge igniting the fuel/air mixture is created in each combustion chamber at the ignition electrode, removing combustion residues that have deposited onto the surface of the insulator located in the combustion chamber from the surface of the insulator in the combustion chamber, in particular using processes of combustion, comprising the step of temporarily enriching the fuel/air mixture with additional fuel, observing the breakdown voltage and triggering a cleaning procedure when a setpoint value of the impedance falls below a threshold value.

* * * * *